United States Patent [19]

Moomaw

[11] Patent Number: 4,718,613

[45] Date of Patent: Jan. 12, 1988

[54] GUTTER CLEANING DEVICE

[76] Inventor: David E. Moomaw, 423 Oakwood Ave., East Aurora, N.Y. 14052

[21] Appl. No.: 905,699

[22] Filed: Sep. 9, 1986

[51] Int. Cl.[4] ..... B02C 19/00

[52] U.S. Cl. ..... 241/60; 15/236 C; 241/101.7; 241/277

[58] Field of Search ..... 241/101.7, 101.1, 101.2, 241/62, 60, 277, 38, 46 R, 46.15; 15/23, 27, 24, 92, 236 R, 236 B, 236 C; 134/167 R, 167 C; 401/118, 119; 404/90

[56] References Cited

U.S. PATENT DOCUMENTS

| | | | |
|---|---|---|---|
| 3,041,655 | 7/1962 | Entler | 15/236 RX |
| 4,151,624 | 5/1979 | Montalvo | 15/23 |
| 4,168,559 | 9/1979 | Henson | 15/23 |
| 4,303,348 | 12/1981 | O'Brien | 15/236 RX |

*Primary Examiner*—Mark Rosenbaum
*Attorney, Agent, or Firm*—Frost & Jacobs

[57] ABSTRACT

The present invention is a water-powered device for cleaning gutters and the like. An elongated housing includes a water-powered motor comprising an internal paddlewheel mated to a first end of a gear train. A fitting is attached to a first end of the housing. The fitting is connected to a conventional hose to provide a stream of water to the paddlewheel. A drive gear is mated to a second end of the gear train. Drums having cleats are mounted to the gear train. As the water rotates the paddlewheel, the gear train reduces the rotational speed and increases the torque delivered to the drive gear and the drums. As the drums rotate and mulch debris in the gutter, the device advances forward. Water is flushed from the housing through specially oriented ports into the gutter to enhance the mulching of debris.

25 Claims, 7 Drawing Figures

GUTTER CLEANING DEVICE

BACKGROUND OF THE INVENTION

1. Field of the Invention

The present invention relates generally to a device for cleaning gutters and the like, and more particularly is concerned with a water-powered cleaning device which is completely insertable into a gutter.

2. Description of the Prior Art

Gutters collect leaves, twigs, and other debris and must be cleaned periodically to permit unimpeded flow of water. Frequently, gutters, downspouts and the like are cleaned manually. Oftentimes, water is flushed in a gutter to enhance the removal of debris. Manual cleaning of gutters is time-consuming, laborious, and may be hazardous, particularly for elevated gutters. Furthermore, some gutters may be inconvenient or beyond the reach of a ladder.

A cleaning device for gutters is disclosed in U.S. Pat. No. 4,168,559 issued to Henson in 1979. A curved support member is connected to an electric rotor or other power means. The rotor rotates a plurality of flexible elements which dislodge debris from a gutter. The device may include an attachment through which water is forced into a gutter. Other devices for cleaning gutters and the like, none of which is believed to be more pertinent than that of the '559 patent, include the following U.S. Pat. Nos. 3,023,971; 3,041,655; 3,751,749; 4,151,624; 4,194,780; 4,238,866; 4,447,927.

SUMMARY OF THE INVENTION

The present invention provides an economical and easily-operated device for cleaning gutters and the like. The device includes simultaneous mulching and flushing of debris in a gutter. The device is insertable into a gutter and can travel-beneath nails or ferrules which hold a gutter in place. The device is powered by the same water used for flushing the gutter.

According to the present invention, an elongated housing includes a water-powered motor comprising an internal paddlewheel mated to a first end of a gear train. A fitting is attached to a first end of the housing. The fitting is connected to a conventional hose to provide a stream of water to the paddlewheel. A drive gear is mated to a second end of the gear train. Drums having cleats are mounted to the gear train. As the water rotates the paddlewheel, the gear train reduces the rotational speed and increases the torque delivered to the drive gear and the drums. As the drums rotate and mulch debris in the gutter, the device advances forward. Water is flushed from the housing through specially oriented ports into the gutter to enhance the mulching operation.

DETAILED DESCRIPTION OF THE PREFERRED EMBODIMENT

Figure 1:
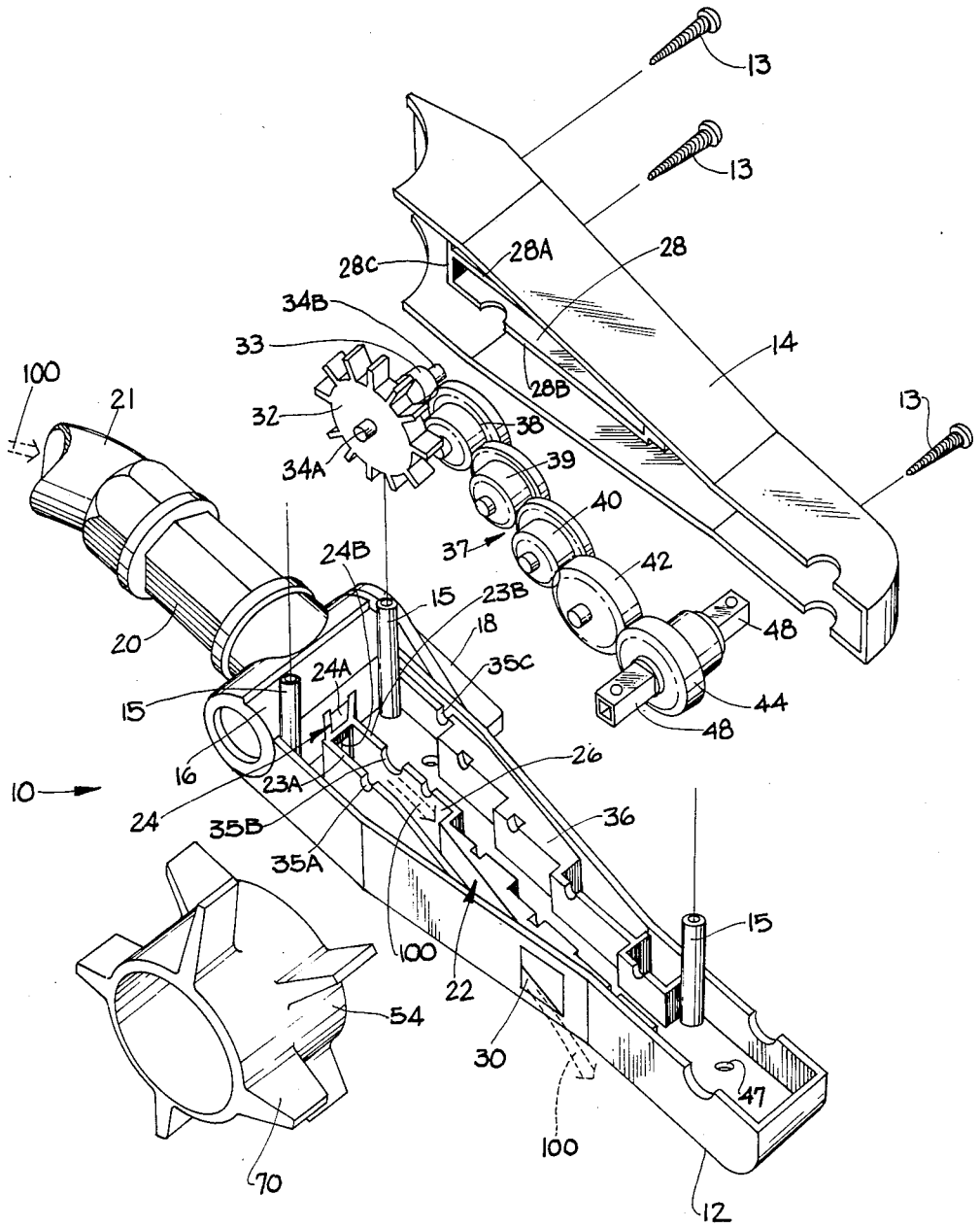
FIG. 1 is an exploded perspective view of an embodiment of the present cleaning device wherein the top panel has been rotated for clarity of illustration.
Figure 2:
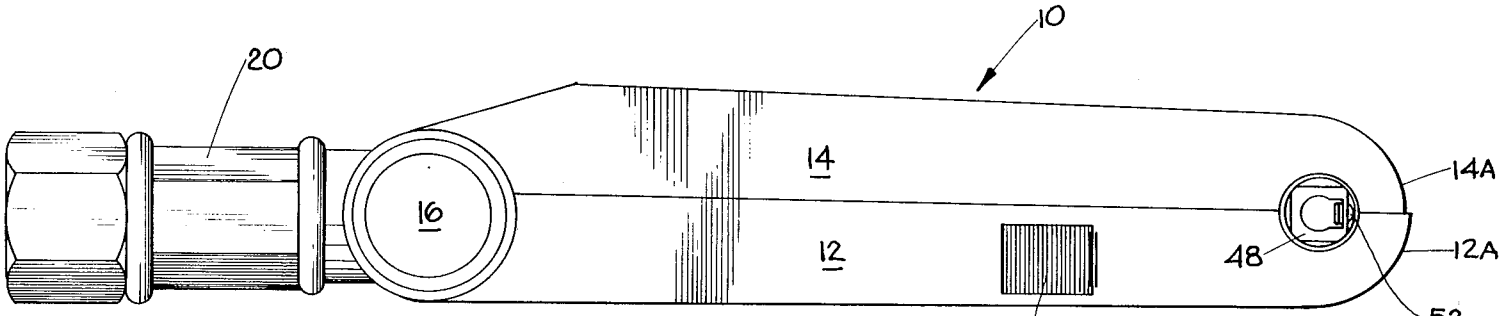
FIG. 2 is a side elevational view of the assembled device of FIG. 1 and with the routing drums removed for clarity of illustration.

A cleaning device of the present invention is generally indicated at 10 in the exploded perspective view of FIG. 1. The device 10 includes an elongated body or housing 12. A cover or panel 14 is fitted and secured to the housing 12 (as illustrated in the assembled view of FIG. 2) to form an enclosure for internal mechanisms described below. Fasteners 13 are used to hold the cover 14 to the housing 12 and are received in bosses 15. If desired, the cover 14 may be secured to the housing 12 by other means such as gluing or sonic welding. It is preferred that leading edges 12A and 14A of the housing 12 and cover 14, respectively, be curved or rounded. Such configurations enhance the advancement of the device 10 in a gutter as described below.

A conventional on/off valve 16 is mounted to an aft end of the housing 12. Flow through the valve 16 is controlled by a valve handle 18. A conventional hose fitting 20 is rigidly connected to the valve 16. The fitting 20 includes internal threads (not shown) for mating with a conventional hose 21 in known manner. The hose 21 is connected at its opposite end to any water line. An alternate water source, which may contain soap, cleaning fluid, etc., can be pumped through the hose 21 if desired.

Figure 3:
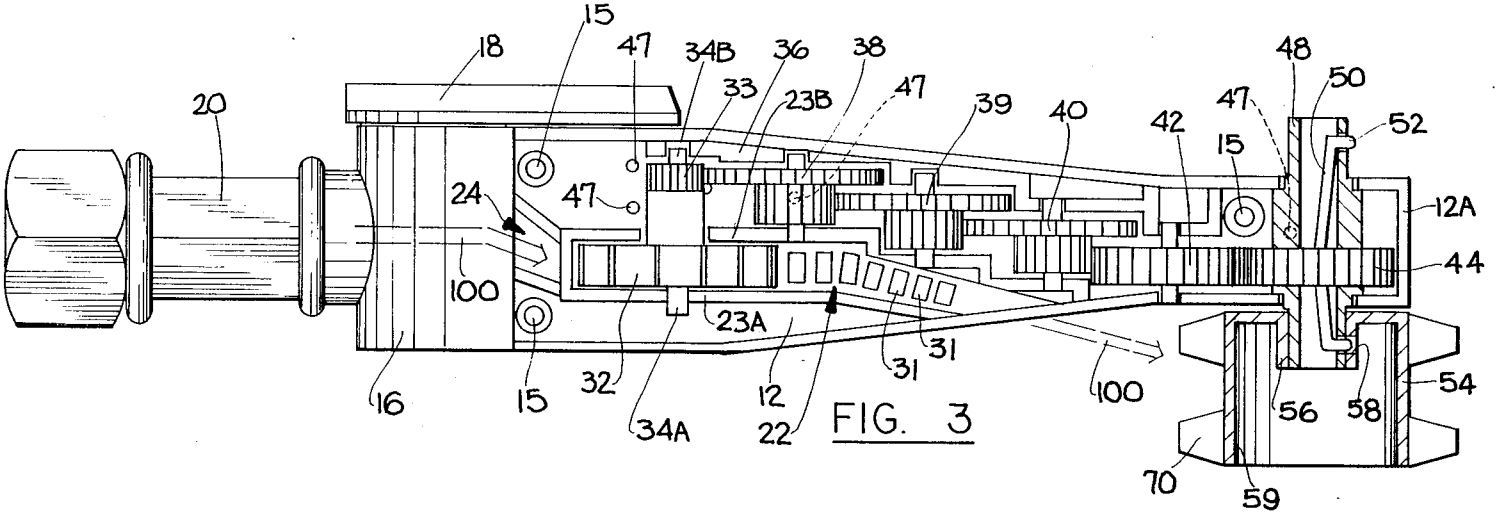
FIG. 3 is a top plan view of the device of FIG. 2 with the cover removed illustrating the internal construction and one routing drum mounted to the device.

As illustrated in FIGS. 1 and 3, an internal passageway indicated generally at 22 is provided for directing water through the housing 12. The passageway 22 is formed from generally parallel sidewalls 23A and 23B projecting upwardly from the bottom surface of the housing 12. The passageway 22 includes an entrance spout indicated generally at 24, a lower channel portion 26, an upper channel portion 28, and an exit port 30.

The entrance spout 24, formed by a top wall 24A provided between the portion of the sidewalls 23A and 23B adjacent the valve 16, is in communication with the valve 16. An opening 24B is provided to permit water to flow to the lower and upper channel portions 26 and 28. The spout 24 acts like a nozzle and directs water from the valve 16 to the passageway 22.

The upper channel portion 28 is illustrated in FIG. 1 where the cover 14 has been axially rotated for clarity. The upper channel portion 28 is formed from generally parallel sidewalls 28A and 28B and an end wall 28C. When the cover 14 is assembled onto the housing 12, sidewalls 28A and 28B and end wall 28C align with sidewalls 23A and 23B and spout 24, respectively, to enclose the passageway 22. If desired, a seal can be inserted between the channel portions 26 and 28 to reduce any leakage from the passageway 2. It is preferred that the passageway 22 be integrally constructed with the housing 12.

In FIGS. 1 and 3 the flow of water through the device is illustrated by the phantom lines and arrows indicated at 100. Water exits the housing 12 from the exit port 30. The exit port 30 can be constructed on either side of the housing 12, through the bottom surface of the housing 12, and/or through the cover 14.

Water slots or vents 31, illustrated only in FIG. 3, are provided in the floor of the lower channel portion 26. Water not directed through the exit port 30 escapes through the vents 31 to flush debris from the bottom surface of a gutter.

A paddlewheel 32 is rotatably mounted in the passageway 22 adjacent the opening 24B of the spout 24. The paddlewheel 32 includes a gear portion 33 and axle stubs 34A and 34B projecting outwardly from opposite sides. Grooves 35A and 35B are provided in sidewalls 23A and 23B for receiving the paddlewheel 32. A support wall 36 is spaced from and generally parallel to sidewall 23B. Support wall 36 includes a groove 34C for receiving axle stub 34B. The gear portion 33 is suspended between sidewall 23B and the support wall 36. When the cover 14 is assembled onto the housing 12, the paddlewheel 32 rotates freely within the lower and upper channel portions 26 and 28. As water travels through the opening 24B of the entrance spout 24, it is directed against the paddlewheel 32. The force of the water causes the paddlewheel 32 and gear portion 33 to rotate at the same relatively high velocity.

A gear train indicated generally at 37 is rotatably mounted within the housing 12 and includes a plurality of gear members. In the embodiment of the Figures, the gear train 37 is rotatably mounted in an end-to-end manner between sidewall 23B and the support wall 36. A first gear reducer 38 is meshingly engaged with the gear portion 33 of the paddlewheel 32. A second gear reducer 39 is meshingly engaged with the first gear reducer 38. A third gear reducer 40 is meshingly engaged with the second gear reducer 39. A fourth gear 42 is meshingly engaged with the third gear reducer 40. Each gear member includes axle stubs which are received in corresponding grooves in sidewall 23B and the support wall 36.

A drive gear 44 is rotatably mounted in the fore end of the housing 12 and meshes with the fourth gear 42. The gear train 37 thus provides a means of transmitting the rotation of the paddlewheel 32 to the drive gear 44 by reducing speed and increasing torque. The paddlewheel 32 and the gear train 37 also act as a water-powered motor or drive for advancing the device 10. In one embodiment, for example, the gear portion 33 of the paddlewheel 32 can have 8 teeth, the gear reducers 38, 39, and 40 can have ratios of 26 teeth/12 teeth, and the fourth gear 42 can have 24 teeth. Thus the gear train 37 reduces the rotational speed of the paddlewheel 32 by a factor of 30.5:1. Other gear combinations and systems are within the scope of the present invention.

Drains 47 are provided in the floor of the housing 12 below the gear train 37 to permit the escape of any water leaking into this area.

Figure 7:
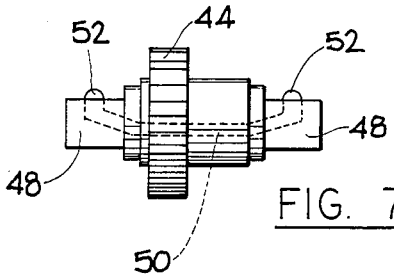
FIG. 7 is a side view of a drive gear of the present invention.

The drive gear 44 includes axle portions 48,48 which extend perpendicularly from the plane of the drive gear 44. As shown best in FIG. 2, each axle 48 is of rectangular cross-section; however, other cross-sections are within the scope of the present invention. A flat, retaining spring 50 is mounted internally within the axle portions 48,48. Spring ends 52,52, seen best in FIG. 7, protrude slightly from the surface of each axle 48.

Figure 4:
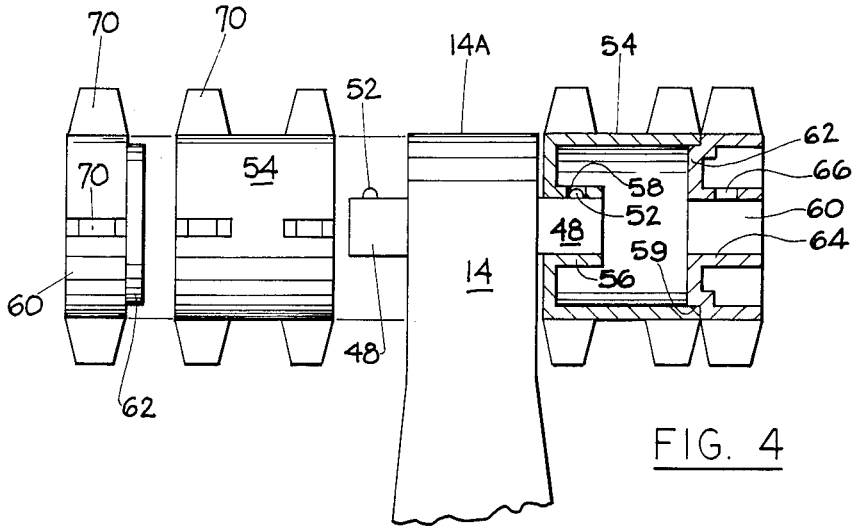
FIG. 4 is a fragmentary partially exploded top plan view of the devive of FIG. 2 illustrating routing drums mounted on the device.
Figure 5:
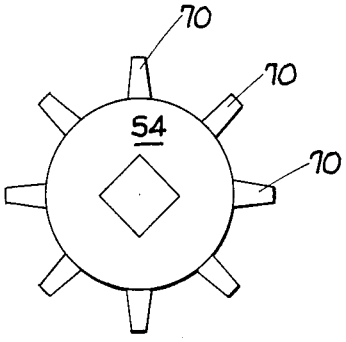
FIG. 5 is an end view of a routing drum.

A wheel or routing drum 54 is mounted to each axle portion 48. It is preferred that each drum 54 be hollow and include a mounting sleeve 56. The internal diameter of the mounting sleeve 56 is constructed to correspond to the cross-section of each axle 48. A slot 58, shown in FIGS. 3 and 4, is provided in each sleeve 56. An axle 48 is inserted into a sleeve 56 until a spring end 52 "snaps" or "locks" into a slot 58 to secure a drum 54 to the device 10. To remove a drum 54 from an axle 48, a force is applied until a spring end 52 disengages a slot 58. Drums 54 rotate as the drive gear 44 is rotated, causing the device 10 to advance.

It is preferred that the width of each drum 54 be constructed so that the device 10 with drums 54,54 mounted thereon fits within a conventional gutter. In certain applications, it is desirable to increase the width of a drum 54. An adaptor 60 having an external rim 62 is press-fitted into an outer circumference 59 of a drum 54. Use of an adaptor 60 provides on-site adjustability of the width of a drum 54. It is further preferred that each adaptor 60 include an internal sleeve 64 having a slot 66 (shown in FIG. 4) so that an adaptor 60 can be mounted to an axle 48 without a drum 54 when a narrow gutter or area is encountered. It is to be understood that various widths and combinations of drums 54 and adaptors 60 are within the scope of the present invention.

Figure 6:
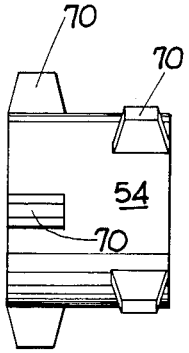
FIG. 6 is a side view of the routing drum of FIG. 5.

Each drum and adaptor includes teeth or cleats 70. Cleats 70 extend substantially radially from the outer surface of a drum 54. Various cleat configurations are within the scope of the present invention including a "stagger tooth" profile illustrated in FIGS. 1 and 6. Cleats 70, which may be provided with sharpened edges, enhance the cleaning ability of the device 10 by mulching debris in a gutter as the drum 54 is rotated.

In operation, a conventional hose 21 is connected to the fitting 20. The flow of water through the housing 12 is controlled by the valve 16. No flow is permitted in an "off" position while all of the flow from the hose is permitted to pass through the housing 12 in an "on" position.

Water passes from the valve 16 to the entrance spout 24 and engages the paddlewheel 32 causing it to rotate. Water travels through the passageway 22 and exits through the exit port 30 and the water vents 31. It is preferred that the exit port 30 be constructed so that water is directed toward a drum 54 so as to enhance the mulching and flushing operation. Any water leaking from the passageway 22 to the gear train 37 area is released through drains 47.

As the paddlewheel 32 rotates, the gear train 37 is set in motion. Increased torque at the drums 54, provided by the gear train 37, causes the drums 54 to rotate, thereby advancing the entire device 10 within the gutter or downspout. At the same time, water exiting through the vents 31 is directed toward the aft end of the housing 12, also forcing the device 10 forwardly within the gutter or downspout. The speed of the device 10 is dependent upon flow of water through the valve 16.

The exiting water from the port 30 and vents 31 and the mulching of the drums 54 and cleats 70 serve to clean and flush debris from the gutter or downspout. The rounded edges 12A and 14A also enhance the ability of the device 10 to advance and move forward through leaves, twigs, and other trash in a gutter.

It is preferred that the housing 12 be constructed from a strong and lightweight material such as plastic. Such material should be easy to clean and resist breakage. The gear train 37 can also be made of a lightweight material. It is preferred that the gear train 37 have spur gears to provide maximum mechanical advantage.

Although the present invention has been described with reference to a preferred embodiment, workers skilled in the art will recognize that changes may be made in form and in detail without departing from the spirit and scope of the invention.

What is claimed is:

1. A self-propelled gutter cleaning device, powered by water supplied from a hose, comprising:
(a) an elongated body constructed and arranged to fit within a gutter;
(b) hose receiving means connected to a first end of the body;
(c) a paddlewheel having a gear portion rotatably mounted within the body;
(d) a passageway constructed and arranged within the body for directing water from the hose receiving means against the paddlewheel so as to cause rotation thereof;
(e) at least one exit port constructed and arranged in communication with the passageway for directing water from the body into the gutter;
(f) a gear train rotatably mounted within the body and meshingly engaged with the gear portion of the paddlewheel; and
(g) at least one drum removably connected to the gear train for mulching debris and advancing the device in the gutter as water rotates the paddlewheel which in turn rotates the gear train and the drum.

2. The device as specified in claim 1 wherein the hose receiving means comprises a fitting having threads for mating with the hose.

3. The device as specified in claim 1 and further including a valve mounted between the hose receiving means and the passageway for controlling the flow of water through the body.

4. The device as specified in claim 1 wherein the gear train comprises a plurality of meshingly engaged gear members.

5. The device as specified in claim 4 wherein the gear members are spur gears.

6. The device as specified in claim 4 wherein the gear member at the end of the gear train opposite the paddlewheel includes axle portions for receiving drums.

7. The device as specified in claim 6 wherein each axle portion includes a retaining means for securing a drum.

8. The device as specified in claim 7 wherein the retaining means comprises a flat spring mounted internally in the end gear member having ends which protrude slightly above the surface of each axle portion.

9. The device as specified in claim 1 including an adaptor for expanding the width of a drum.

10. The device as specified in claim 9 wherein each adaptor includes means for removably connecting it to the gear train axle in lieu of a drum.

11. The device as specified in claim 1 wherein the passageway is constructed integrally within the body.

12. The device as specified in claim 1 wherein the exit port is constructed integrally within the body.

13. The device as specified in claim 1 wherein the exiting water is directed from an exit port against a rotating drum.

14. The device as specified in claim 1 wherein each drum includes cleats for mulching debris in a gutter or downspout.

15. The device as specified in claim 1 and including drains in the body adjacent to the gear train to permit the escape of water.

16. A self-propelled water-powered device for cleaning a gutter comprising:
(a) housing means constructed and arranged to fit inside a gutter or downspout;
(b) paddlewheel means rotatably mounted within the housing means;
(c) means associated with the housing means for receiving and dispersing a water supply and directing the water to the paddlewheel means;
(d) mulching means rotatably connected to the housing means for mulching debris and advancing the device in a gutter;
(e) means for transmitting the rotation of the paddlewheel means to the mulching means.

17. The device as specified in claim 16 wherein the means for receiving and dispersing a water supply comprises:
(a) a fitting connected to a first end of the housing means; and
(b) a passageway constructed in the housing means and having
(i) an entrance spout in communication with the fitting and the paddlewheel means; and
(ii) a channel in communication with the paddlewheel means and terminating in an exit port, whereby water passes through the fitting and entrance spout causing the paddlewheel means to rotate, such water then exiting the housing means through the channel and port.

18. The device as specified in claim 16 wherein the mulching means comprises at least one drum having cleats.

19. The device as specified in claim 18 wherein the drum is removably connected to the housing means.

20. The device as specified in claim 16 wherein the means for transmitting the rotation of the paddlewheel means to the mulching means comprises a gear train rotatably mounted within the housing means and meshingly engaged at a first end to a gear portion of the paddlewheel means and meshingly engaged at a second end to a drive gear having axle portions for receiving the mulching means.

21. The device as specified in claim 20 wherein the gear train comprises a plurality of meshingly engaged gear members.

22. A self-propelled device for cleaning gutters and downspouts, comprising:
(a) housing means designed to fit within a gutter for receiving a supply of water; and
(b) mulching means rotatable connected to the housing means and driven by the water supply for mulching debris within the gutter and advancing the device in the gutter.

23. The device as specified in claim 22 including means for flushing debris from the gutter with the same water utilized for driving the mulching means.

24. A self-propelled device for mulching debris in a gutter comprising:
(a) housing means designed to fit within the gutter for receiving a supply of water;
(b) mulching means rotatably connected to the housing means for mulching debris and advancing the device in the gutter; and
(c) water-powered drive means mounted inside the housing means for rotating the mulching means.

25. The device as specified in claim 24 wherein the water-powered drive means comprises:
(a) a paddlewheel rotatably mounted inside the housing means;
(b) an internal passageway constructed inside the housing means for directing water to the paddlewheel; and
(c) a gears train meshingly engaged at a first end to the paddlewheel and meshingly engaged at a second end to the mulching means;
whereby the paddlewheel rotates when contacted by the water and the rotation is transmitted by the gear train to the mulching means.

* * * * *